US011994043B2

(12) United States Patent
Foster et al.

(10) Patent No.: US 11,994,043 B2
(45) Date of Patent: May 28, 2024

(54) CONTAMINANT PATHWAY FOR CAMSHAFT PHASER

(71) Applicant: Schaeffler Technologies AG & Co. KG, Herzogenaurach (DE)

(72) Inventors: Colin Foster, Belle River (CA); Shannon Fandale, Sterling Heights, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 17 days.

(21) Appl. No.: 17/685,486

(22) Filed: Mar. 3, 2022

(65) Prior Publication Data

US 2023/0279789 A1 Sep. 7, 2023

(51) Int. Cl.
*F01L 1/344* (2006.01)

(52) U.S. Cl.
CPC ... *F01L 1/3442* (2013.01); *F01L 2001/34436* (2013.01); *F01L 2001/34459* (2013.01); *F01L 2001/34469* (2013.01)

(58) Field of Classification Search
None
See application file for complete search history.

(56) References Cited

U.S. PATENT DOCUMENTS 6,948,467 B2 9/2005 Lipke et al.
7,318,400 B2 1/2008 Lipke et al.
2008/0289594 A1 11/2008 Kleiber
2010/0050966 A1* 3/2010 Ozawa ..... F01L 1/3442 464/160
2011/0259289 A1* 10/2011 Fujiyoshi ..... F01L 1/3442 123/90.15
2011/0315102 A1* 12/2011 David ..... F01L 1/352 123/90.15
2012/0000437 A1* 1/2012 Ozawa et al. ..... F01L 1/344 123/90.15
2013/0180482 A1 7/2013 Weber
2020/0325801 A1 10/2020 Camilo et al.

FOREIGN PATENT DOCUMENTS

DE 102014206620 A1 * 10/2015 ..... F01L 1/3442
DE 102015205383 A1 * 9/2016 ..... F01L 1/344
DE 102017126574 A1 5/2019
EP 1302630 A2 * 4/2003 ..... F01L 1/3442
EP 2711511 A2 * 3/2014 ..... F01L 1/34
WO WO-2016114019 A1 * 7/2016 ..... F01L 1/047

OTHER PUBLICATIONS

WO-2016114019-A1, English Language Machine Translation (Year: 2016).*
DE-102014206620-A1, English Language Machine Translation (Year: 2015).*

* cited by examiner

*Primary Examiner* — Wesley G Harris

(57) ABSTRACT

A camshaft phaser is provided that includes a rotor, a stator, and a locking cover. The rotor is selectively locked to the stator via a locking assembly arranged within a locking bore of the rotor. Contaminant particles that enter a first locking end of the bore are exited out a second venting end of the bore via a contaminant particle exit pathway.

20 Claims, 6 Drawing Sheets

CONTAMINANT PATHWAY FOR CAMSHAFT PHASER

TECHNICAL FIELD

Example aspects described herein relate to camshaft phasers, and, more particularly, to camshaft phasers utilized within an internal combustion (IC) engine.

BACKGROUND

Camshaft phasers are utilized within IC engines to adjust timing of an engine valve event to modify performance, efficiency and emissions. Hydraulically actuated camshaft phasers can be configured with a rotor and stator arrangement. The rotor can be connected to a camshaft and actuated hydraulically in clockwise or counterclockwise directions relative to the stator to achieve variable engine valve timing. The rotor can include a locking pin assembly that selectively locks the rotor to the stator.

SUMMARY

An example embodiment of a camshaft phaser includes a stator, a rotor rotatable with respect to the stator, a locking cover fixed to the stator, and a locking assembly configured to be actuated via hydraulic fluid. The locking assembly includes a locking part, a spring, and a retainer arranged within a bore of the rotor. In a first locked position of the locking assembly, the locking part protrudes from a first locking end of the bore and engages the locking cover. In a second unlocked position of the locking assembly, the locking art is disengaged from the locking cover so that the rotor can rotate relative to the stator. The bore includes a contaminant particle exit pathway (CPEP) extending from the first locking end to a second venting end of the bore so that contaminant particles entering the first locking end are exited out the second venting end via the CPEP. The CPEP can include a radial passage and a longitudinal passage, both arranged on a radial inner surface of the bore. The longitudinal passage is fluidly connected to the radial passage. The radial passage can be arranged upstream of the longitudinal passage and can be in the form of a radial groove that extends for 360 degrees. The longitudinal passage can extend to a medial longitudinal position within the bore to a spring well formed between the retainer and the locking part. The retainer can include an outlet passage that is configured to fluidly connect the spring well to the second venting end of the bore. The second venting end of the bore can be fluidly connected to a vent passage arranged on an axial face of the rotor.

In an example embodiment, the CPEP is configured to be closed by the locking part in the first locked position and opened by the locking part in the second unlocked position. More specifically, the radial passage is fluidly disconnected from the first locking end of the bore via the locking part in the first locked position; and, the radial passage is fluidly connected to the first locking end of the bore in the second unlocked position.

In an example embodiment, the longitudinal passage extends from the radial passage to the second venting end of the bore.

In an example embodiment, the longitudinal passage extends from the radial passage to the outlet passage.

An example embodiment of a camshaft phaser includes a stator, a rotor rotatable with respect to the stator, a locking cover, and a locking assembly arranged within a bore of the rotor that is configured to be actuated via hydraulic fluid to selectively lock the rotor to the stator. The locking assembly and bore define a CPEP extending from a first locking end of the bore to a second venting end of the bore so that contaminant particles entering the first locking end are exited out of the second venting end via the contaminant particle exit pathway. In a further aspect, the CPEP includes a first radial passage, a second longitudinal passage, a spring well formed between the locking part and retainer, and a third longitudinal passage. The first radial passage and the second longitudinal passage can be formed between the locking part and the bore, and the third longitudinal passage can be formed between the retainer and the bore. In a further aspect, the first radial passage and the second longitudinal passage can be arranged in the bore and third longitudinal passage can be arranged on the retainer. The second longitudinal passage can extend from the first radial passage to the second venting end of the bore.

BRIEF DESCRIPTION OF THE DRAWINGS

The above mentioned and other features and advantages of the embodiments described herein, and the manner of attaining them, will become apparent and better understood by reference to the following descriptions of multiple example embodiments in conjunction with the accompanying drawings. A brief description of the drawings now follows.

DETAILED DESCRIPTION OF THE EMBODIMENTS

Figure 1:
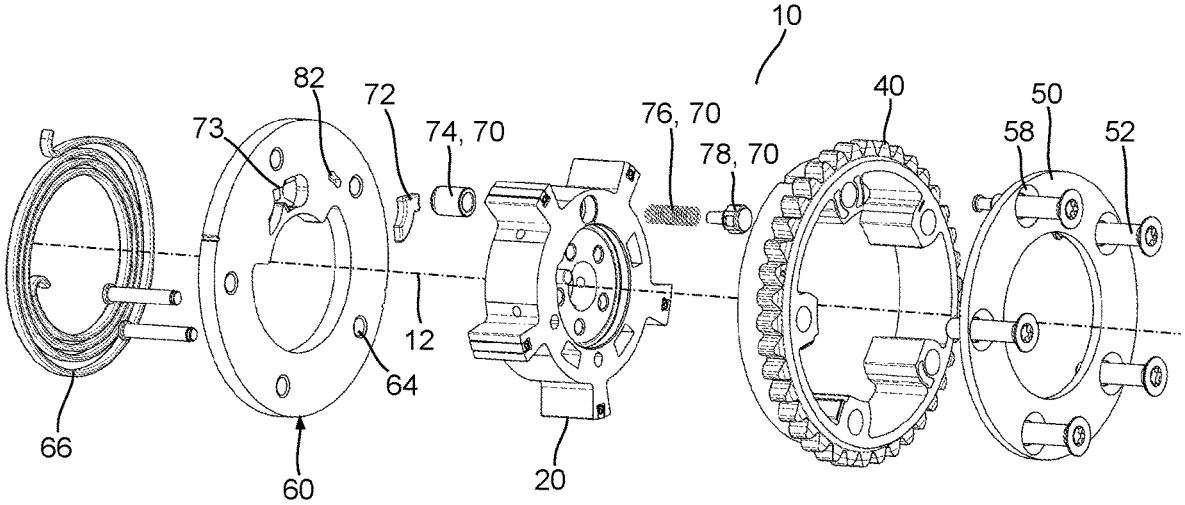
FIG. 1 is an exploded perspective view of an example embodiment of a camshaft phaser that includes a rotor that is: i) hydraulically actuated relative to a stator, and ii) selectively locked to the stator.

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner. Certain terminology is used in the following description for convenience only and is not limiting. The words "inner," "outer," "inwardly," and "outwardly" refer to directions towards and away from the parts referenced in the drawings. Axially refers to directions along a diametric central axis. Radially refers to directions that are perpendicular to the central axis. The words "left", "right", "up", "upward", "down", and "downward" designate directions in the drawings to which reference is made. The terminology includes the words specifically noted above, derivatives thereof, and words of similar import.

Figure 2:
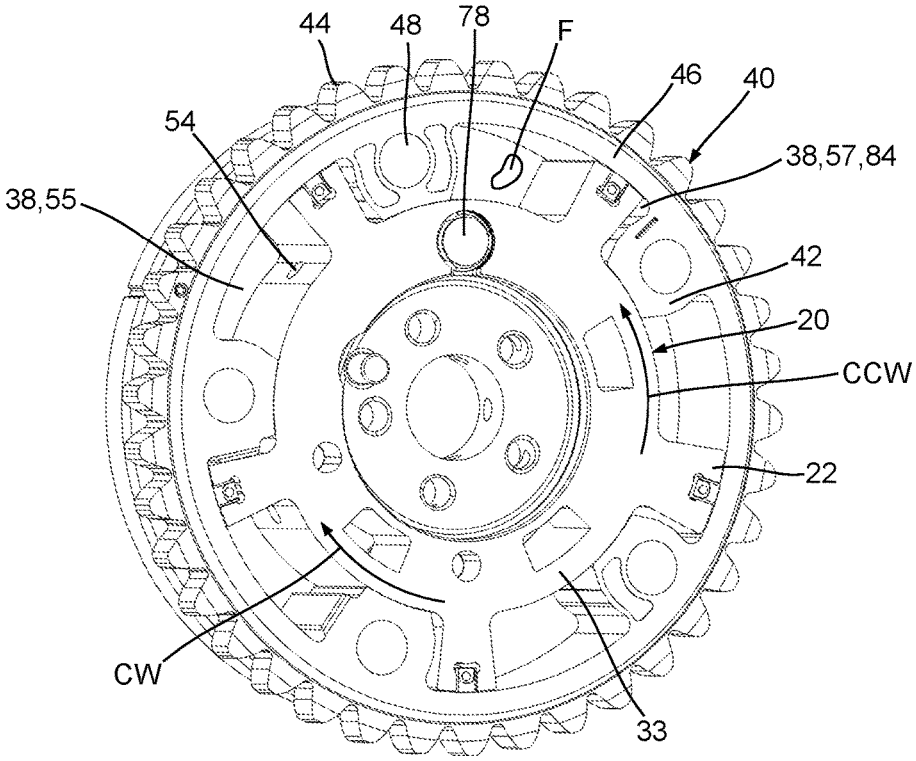
FIG. 2 is a perspective view of an assembly of the rotor, stator, and locking cover of FIG. 1.
Figure 3A:
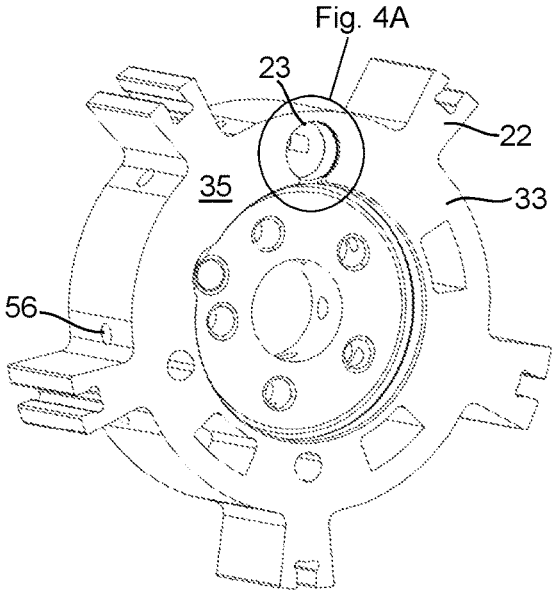
FIG. 3A is a perspective view of a front of the rotor of FIG. 1.
Figure 3B:
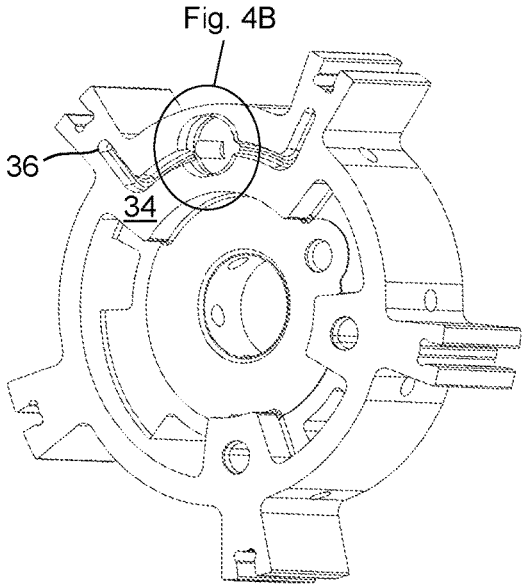
FIG. 3B is a perspective view of a rear of the rotor of FIG. 1.
Figure 4A:
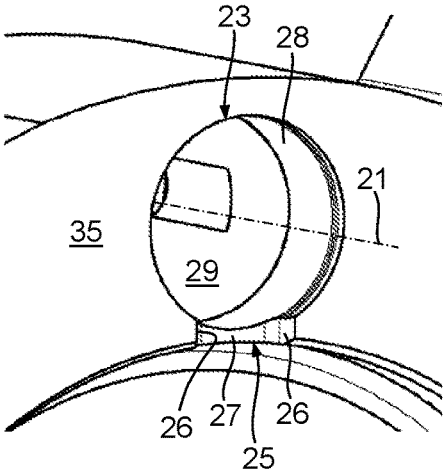
FIG. 4A is a detailed perspective view taken from FIG. 3A.
Figure 4B:
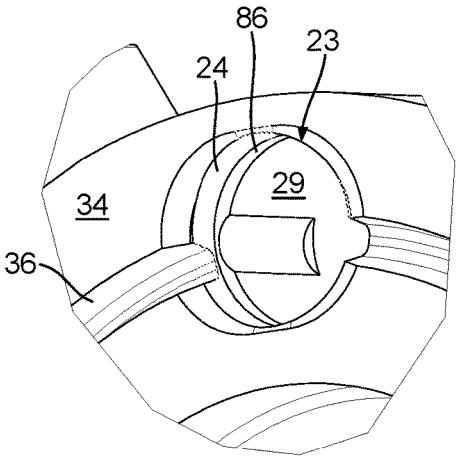
FIG. 4B is a detailed perspective view taken from FIG. 3B.
Figure 5:
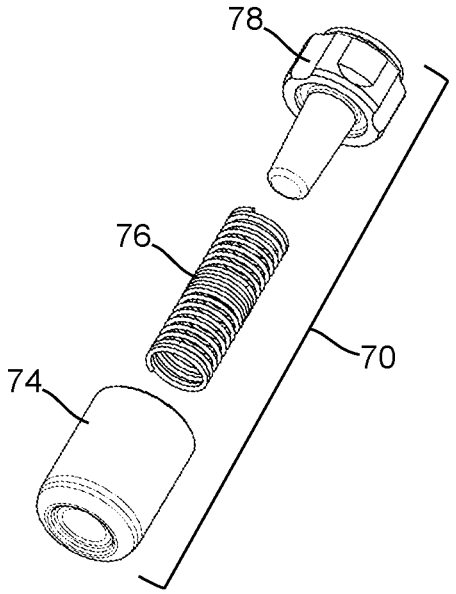
FIG. 5 is a perspective view of a locking assembly.
Figure 6:
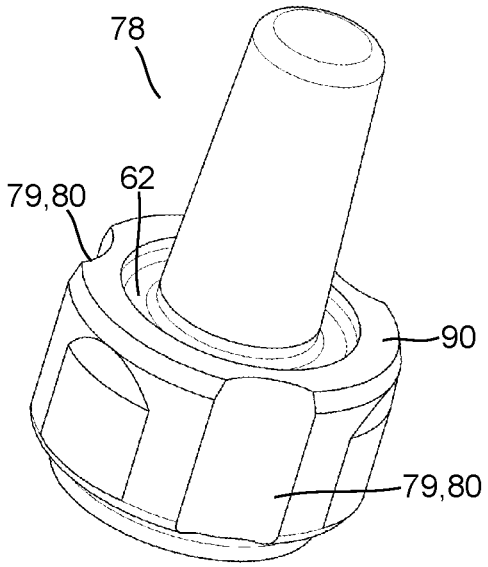
FIG. 6 is a perspective view of a retainer.
Figure 7:
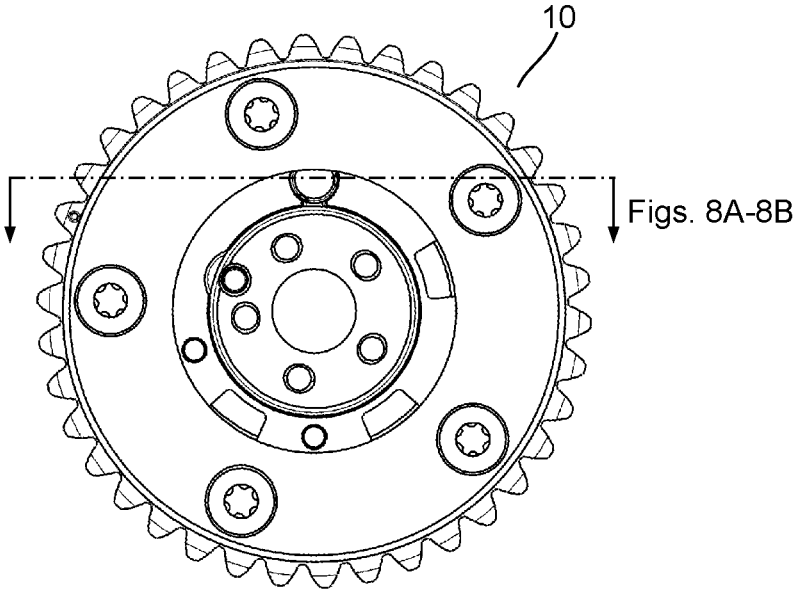
FIG. 7 is a front view of the camshaft phaser of FIG. 1.
Figure 8A:
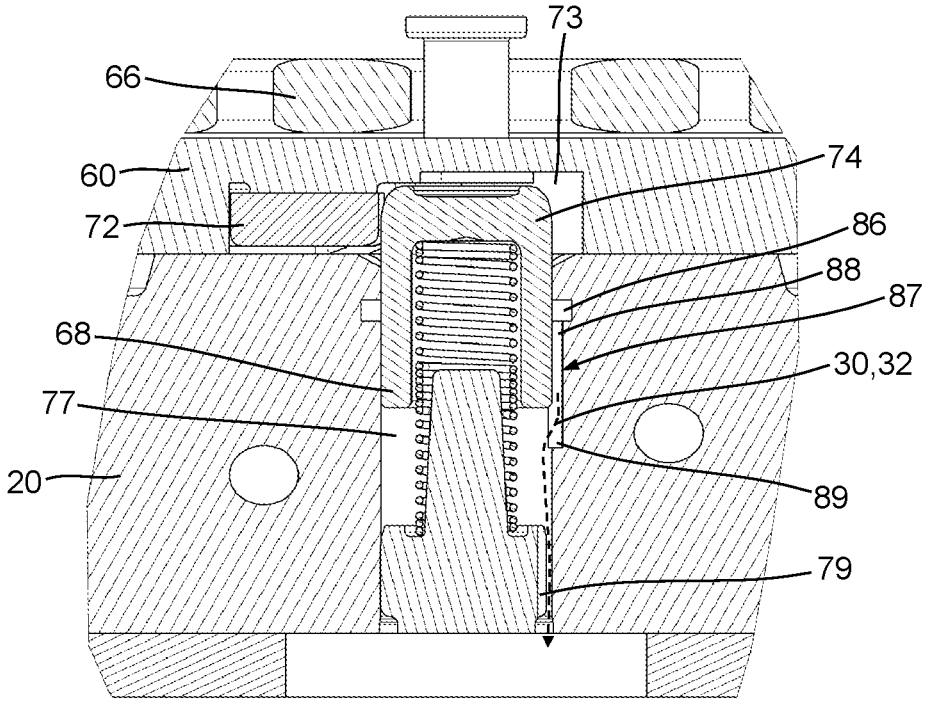
FIG. 8A is a cross-sectional view taken from FIG. 7 with the locking assembly in a first locked position.
Figure 8B:
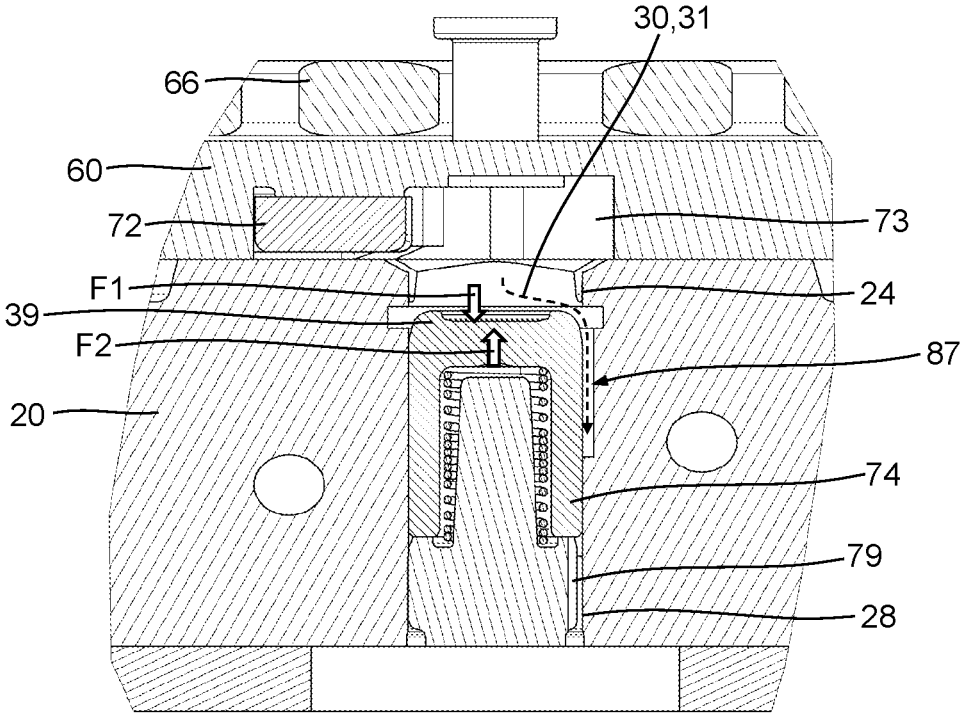
FIG. 8B is a cross-sectional view taken from FIG. 7 with the locking assembly in a second unlocked position.
Figure 9:
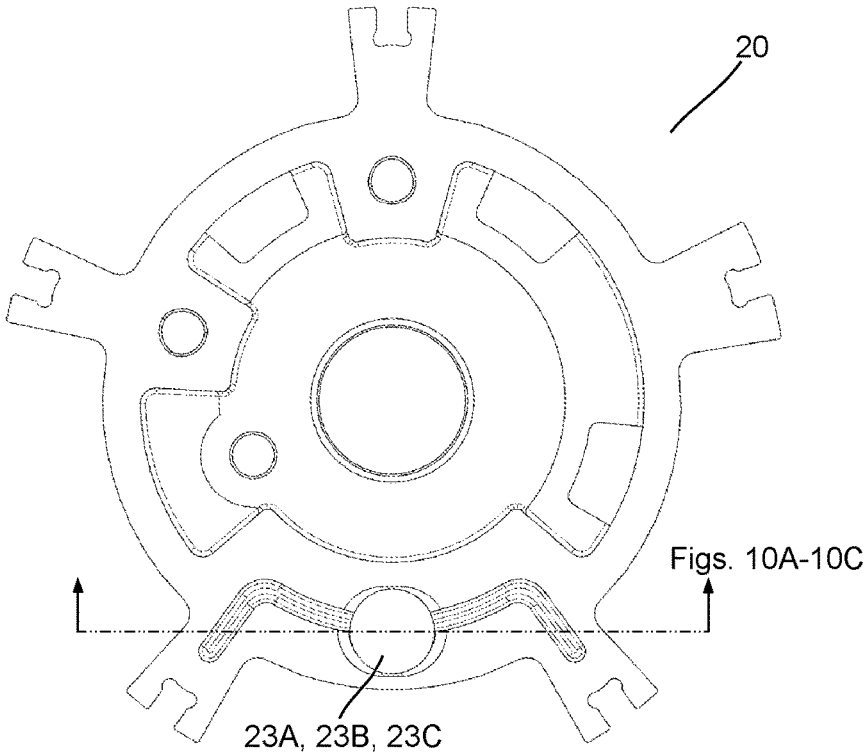
FIG. 9 is a rear view of the rotor of FIG. 1.
Figure 10A:
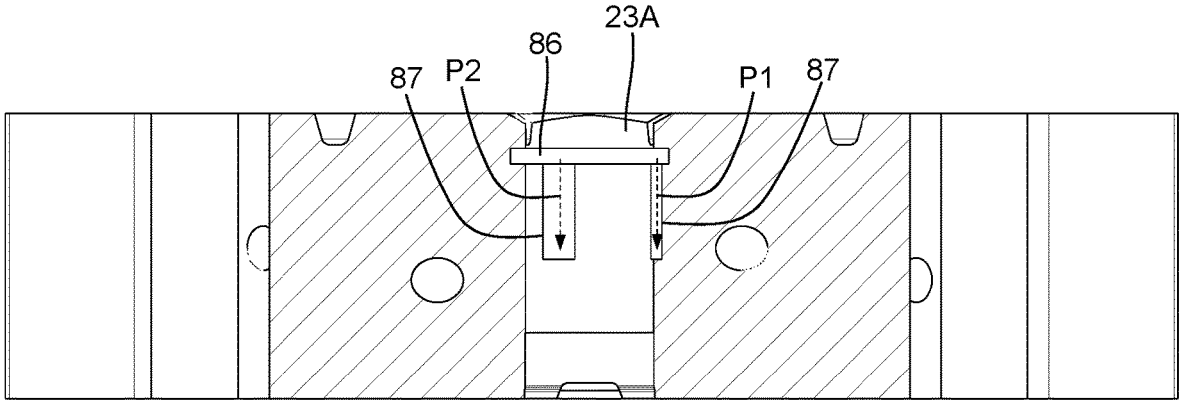
FIG. 10A is a cross-sectional view taken from FIG. 9 showing an example embodiment of a bore for the locking assembly of FIG. 5.
Figure 10B:
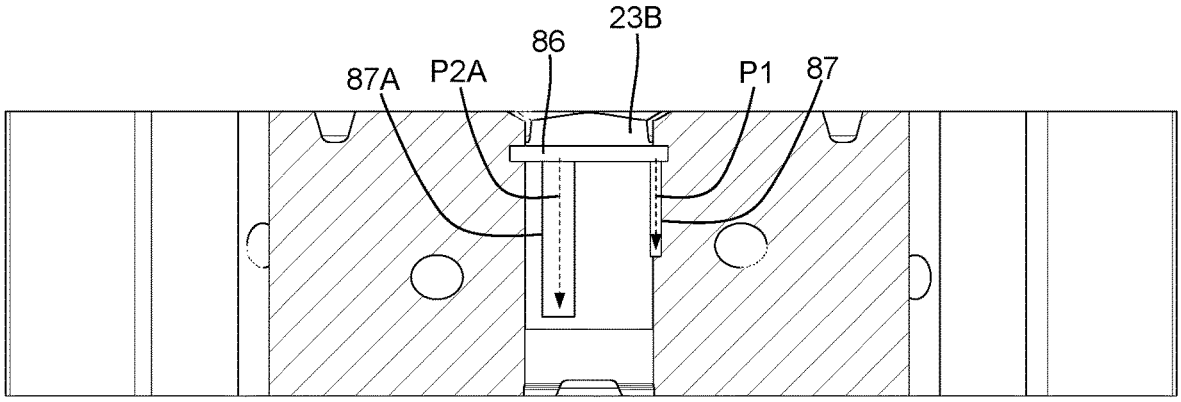
FIG. 10B is a cross-sectional view taken from FIG. 9 showing an example embodiment of a bore for the locking assembly of FIG. 5.
Figure 10C:
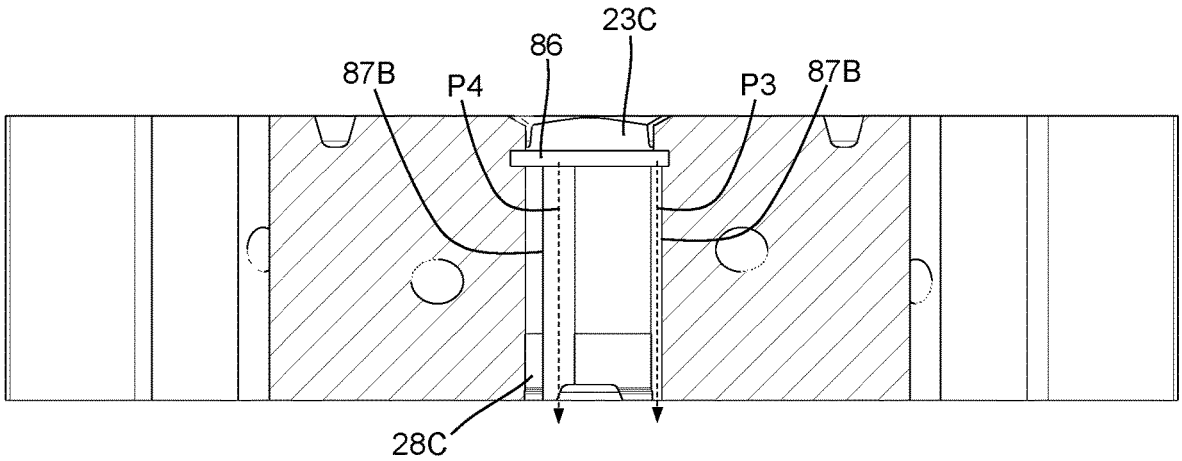
FIG. 10C is a cross-sectional view taken from FIG. 9 showing an example embodiment of a bore for the locking assembly of FIG. 5.

Referring to FIG. 1, an exploded perspective view of an example embodiment of a camshaft phaser 10 is shown that includes a front cover 50, a stator 40, a rotor 20, a locking cover 60, and a bias spring 66. A locking assembly 70 that can lock and unlock the rotor 20 from the locking cover 60, is also shown within FIG. 1. FIG. 2 shows a perspective view of the rotor 20 and stator 40 of FIG. 1. FIGS. 3A and 3B show respective front and rear perspective views of the rotor 20 of FIG. 1. FIG. 4A shows a detailed view taken from FIG. 3A. FIG. 4B shows a detailed view taken from FIG. 3B. FIG. 5 shows a perspective view of a locking assembly 70. FIG. 6 shows a perspective view of a retainer 78. FIG. 7 shows a front view of the camshaft phaser 10 of FIG. 1. FIGS. 8A and 8B show cross-sectional views taken from FIG. 7 with the locking assembly 70 in respective first locked and second unlocked positions. FIG. 9 shows a rear view of the rotor 20. FIGS. 10A through 10C show different example embodiments of a locking bore of the rotor 20. The following discussion should be read in light of FIGS. 1 through 10C.

The stator 40 of the camshaft phaser 10 is configured with an endless drive band interface 44 to rotationally connect the camshaft phaser 10 to a power source (not shown), potentially to that of a crankshaft of an internal combustion (IC) engine. An endless drive band such as a belt or chain (not shown) can be utilized to facilitate this connection, causing the camshaft phaser 10 to rotate around a rotational axis 12.

A term "non-rotatably connected" can be used to help describe various connections of camshaft phaser components and is meant to signify two elements that are directly or indirectly connected in a way that whenever one of the elements rotate, both of the elements rotate in unison, such that relative rotation between these elements is not possible. Radial and/or axial movement of non-rotatably connected elements with respect to each other is possible, but not required. With this term established, the rotor 20 of the camshaft phaser 10 is non-rotatably connected to a camshaft (not shown). The rotor 20 includes vanes 22 that extend radially outward from a hub 33 of the rotor 20. The stator 40 includes protrusions 42 that extend radially inward from an outer ring portion 46 of the stator 40. A plurality of fasteners 52 extend through front apertures 58 of the front cover 50, through clearance apertures 48 of the stator 40, and attach to locking apertures 64 of the locking cover 60. Therefore, the front cover 50, stator 40, and locking cover 60 are fixed to each other via the fasteners 52 and rotate together in unison. The front cover 50 and locking cover 60, together with the vanes 22 of the rotor 20 and protrusions 42 of the stator 40, form hydraulic actuation chambers 38 within the camshaft phaser 10. The camshaft phaser 10 is hydraulically actuated by pressurized hydraulic fluid F to move the rotor 20 either clockwise CW or counterclockwise CCW relative to the stator 40. Since the rotor 20 is non-rotatably connected to the camshaft, clockwise CW and counterclockwise CCW relative movements of the rotor 20 relative to the stator 40 can advance or retard an engine valve event with respect to a four-stroke cycle of an IC engine. With reference to FIGS. 2 and 3A, clockwise CW rotation of the rotor 20 relative to the stator 40 can be achieved by: 1). pressurization of a first chamber 55 via a first hydraulic fluid port 54; and, 2). de-pressurization of a second chamber 57 via a second hydraulic fluid port 56. Likewise, counterclockwise CCW rotation of the rotor 20 relative to the stator 40 can be achieved by: 1). pressurization of the second chamber 57 via the second hydraulic fluid port 56; and, 2). de-pressurization of the first chamber 55 via the first hydraulic fluid port 54. The preceding pressurization and de-pressurization actions of the first and second hydraulic fluid ports 54, 56 can be accomplished by any suitable electronically controlled hydraulic fluid control device. Such a device can communicate electronically with an electronic controller to control the camshaft phaser 10.

The locking assembly 70 includes a locking part 74, a force generator 76, and a retainer 78. The force generator 76 can be any component that provides a force on the locking part 74 while permitting longitudinal movement of the locking part 74. The force generator 76 can be a bias spring, elastomer or any component that meets these described functional attributes. In an example embodiment, the locking assembly 70 can serve to either lock or unlock the rotor 20 from the stator 40, via the locking cover 60 that is fixed to the stator 40. An insert 72 is disposed within a locking cavity 73 of the locking cover 60. The insert 72 can be hardened to suffice as a locking part interface and can provide a low-cost alternative to hardening the locking cover 60. It could also be possible to eliminate the insert 72 so that the locking part interfaces directly with the locking cavity 73. The retainer 78 is received by and attached (possibly by an interference fit) to a locking bore 23 of the rotor 20 and provides: 1). a reception landing 62 for the force generator 76; and, 2). an outlet passage 79 for air, hydraulic fluid, and contaminant particles to exit a spring well 77 formed within the locking bore 23 between an open end 68 of the locking part 74 and a locking part stop 90 of the retainer 78. The outlet passage 79, as shown in FIG. 6, extends longitudinally and can be formed as one or more concave cut-outs 80 arranged on an outer circumference of the retainer 78; however, other forms of the outlet passage are possible. A vent passage 25 is arranged at a venting end 28 of the locking bore 23 to facilitate an exiting pathway for the air, hydraulic fluid, and contaminant particles that are transported from the spring well 77 via the outlet passage 79. Therefore, the outlet passage 79 fluidly connects the spring well 77 to the venting end 28 and the venting end 28 is fluidly connected to the vent passage 25. The vent passage 25 can be arranged transverse to a center axis 21 of the locking bore 23, and includes a bottom surface 27, and sidewalls 26 that extend from a front axial face 35 of the hub 33 of the rotor 20. The vent passage 25 could also be described as extending in a radial direction or extending radially away from the locking bore 23. Other suitable forms of the vent passage 25 are also possible.

The locking assembly 70 selectively locks the rotor 20 to the stator 40 via the locking cover 60. FIG. 8A shows a first, locked position of the locking part 74, and FIG. 8B shows a second, unlocked position of the locking part 74. The locking assembly 70 is arranged in a "pressureless-locked" configuration, meaning that the rotor 20 will be locked to the stator 40 at hydraulic pressures below a pressure threshold provided by the locking part 74 and force generator 76 tandem. If rotational detachment of the rotor 20 from the stator 40 is necessary, the electronically controlled hydraulic fluid control device can be actuated to provide hydraulic fluid from a pressurized source to the locking assembly 70. A hydraulic fluid pathway to the locking assembly 70 will now be described.

FIG. 2 shows the camshaft phaser in a fully retarded stop position, which, in an example embodiment, depicts a default rotational position of the rotor 20 that is achieved during IC engine shutdown. During engine shutdown, the rotor 20 is biased to the retarded stop position via the bias spring 66 and the force generator 76 pushes the locking part 74 to the first locked position so that the rotor 20 is rotationally locked to the stator 40. After starting the engine, the locking assembly 70 can be unlocked by routing pressurized hydraulic fluid to the second chambers 57. One of the second chambers 57 serves as a locking part actuation chamber 84 (see FIG. 2), and when pressurized, communicates with the locking assembly 70 via: i) a fluid gallery connector 82 arranged on an axial face of the locking cover 60 (see FIG. 1), ii) an unlocking groove 36 arranged on a rear axial face 34 of the rotor (see FIG. 3B) which is fluidly connected with the fluid gallery connector 82 while the rotor 20 is in the fully retarded position, and iii) the locking cavity 73 which is fluidly connected to the unlocking groove 36. When a first end 39 of the locking part 74 is subjected to a hydraulic fluid pressure that yields a force F1 that overcomes a biasing force F2 of the force generator 76, the locking part moves away from the locking cover 60 to a second unlocked position (see FIG. 8B), allowing the rotor 20 to rotate freely relative to the stator 40.

The presence of contaminant particles within the hydraulic fluid can cause the locking part 74 to stick within the locking bore 23, shown as a through-bore with two open ends. To address this issue and possibly others, the locking bore 23 of the rotor 20 includes a contaminant particle exit pathway (CPEP) 30 configured to move contaminant particles from a locking end 24 of the locking bore 23 to the venting end 28 of the locking bore 23. FIGS. 8A and 8B show an example embodiment of the CPEP 30. FIG. 8B shows a first portion 31 of the CPEP 30 that extends from the locking end 24 of the locking bore 23 to a medial position of the locking bore 23. It could be stated that the first portion 31 is a beginning portion of the CPEP 30. FIG. 8A shows a second portion 32 of the CPEP 30 that extends from the medial position of the locking bore 23 to the venting end 28 of the locking bore 23. It could be stated that the second portion 32 is an ending portion of the CPEP 30. The CPEP 30 could be described as a network of passages that can facilitate a transport of contaminant particles, hydraulic fluid, and air. The transport of contaminant particles can be facilitated via a flow of hydraulic fluid that occurs within the CPEP 30. Therefore, it could be stated that the network of the described passages of the CPEP 30 are fluidly connected to each other.

The first portion 31 of the CPEP 30 is facilitated by a radial (circumferentially extending) passage 86 or channel and a longitudinal passage 87 or channel, both arranged on a radial surface 29 of the locking bore 23. The radial passage 86, as shown, is a radial groove that extends for 360 degrees; thus, the radial groove encompasses a full circumference of the locking bore 23 and/or the locking part 74, facilitating a washing or cleansing of the full end of the locking bore 23 and/or the locking part 74 via pressurized hydraulic fluid that flows from the locking cavity 73 to the locking end 24 of the locking bore 23. The radial passage 86 can be longitudinally or axially offset from the locking end 24 of the locking bore 23. Other suitable shapes and locations of the radial passage 86 are also possible. The longitudinal passage 87, as shown, is a longitudinal groove that extends from the radial passage 86 to a medial position of the locking bore 23. A first end 88 of the longitudinal passage 87 is fluidly connected to the radial passage 86 such that hydraulic fluid can flow freely from the radial passage 86 to the longitudinal passage 87. Therefore, it could be stated that the radial passage 86 is located upstream of the longitudinal passage 87.

The second portion 32 of the CPEP 30 includes the longitudinal passage 87, the spring well 77 formed between the retainer 78 and the open end 68 of the locking part 74 while the locking assembly 70 is in the first locked position, and the outlet passage 79 of the retainer 78.

Together, the first and second portions 31, 32 of the CPEP 30 facilitate removal of contaminant particles via transport of the particles from the locking end 24 of the locking bore 23 to the venting end 28 of the locking bore 23. For the embodiment shown in FIGS. 3A-4B and 8A-8B, in the first locked position: i) the radial passage 86 is sealingly closed or covered by the locking part 74; thus, the locking part 74 blocks or closes the fluid connection between the locking end 24 of the locking bore 23 and the radial passage 86, and ii) a second end 89 of the longitudinal passage 87 is fluidly connected to the outlet passage 79 of the retainer 78. Furthermore, in the second unlocked position: i). the locking end 24 of the locking bore 23 is fluidly connected to the radial passage 86, and ii) the second end 89 of the longitudinal passage 87 is blocked by the locking part 74 so that no fluid communication occurs between the longitudinal passage 87 and the outlet passage 79 of the retainer 78.

Therefore, for the first embodiment shown in FIGS. 3A-4B and 8A-8B, intermittent fluid communication occurs between the first and second portions 31, 32 of the CPEP 30, as facilitated by the position of the locking part 74.

FIGS. 10A-10C show different embodiments of the locking bore 23A-23C that can facilitate transport of contaminant particles from the locking end of the locking bore to the venting end of the locking bore.

The locking bore 23A of FIG. 10A includes the radial passage 86 and multiple longitudinal passages 87 which provide multiple longitudinal pathways P1, P2 for contaminant particles to exit the radial passage 86.

The locking bore 23B of FIG. 10B includes the radial passage 86 and longitudinal passages 87, 87A that provide respective longitudinal pathways P1, P2A for contaminant particles to exit the radial passage 86. Longitudinal pathway P2A extends to a further depth within the locking bore 23B than longitudinal pathway P1. In an example embodiment, longitudinal pathway P2A continuously fluidly connects the radial passage 86 to the outlet passage 79 of the retainer 78.

The locking bore 23C of FIG. 10C includes the radial passage 86 and longitudinal passages 87B that provide longitudinal pathways P3, P4 for contaminant particles to exit the radial passage 86. The longitudinal passages 87B extend from the radial passage 86 to the venting end 28C of the locking bore 23C. Therefore, in the second unlocked position of the locking assembly 70, the locking part 74 does not fluidly disconnect the longitudinal passages 87B from the outlet passage 79; rather, the longitudinal passages 87B and the longitudinal extent thereof, provide for continuous fluid connection between the radial passage 86 and the venting end 28C of the locking bore 23C. It could also be stated that the longitudinal passages 87B fluidly connect the radial passage 86 to the outlet passage 79 of the retainer. Furthermore, in an example embodiment, the presence of the longitudinal passages 87B and corresponding longitudinal pathways P3, P4 may facilitate elimination of the outlet passage 79 of the retainer 78.

It should be stated that the previously described features of the locking assembly 70 and the corresponding interfacing features of the locking bores 23, 23A-23C are interchangeable. For example, it is possible to incorporate at least a portion of the longitudinal passage 87, 87A, 87B on an outer surface of the locking part 74; and, furthermore, it is possible to move the outlet passage 79 from the retainer 78 to an inner radial surface of the locking bores 23, 23A-23C. Therefore, the CPEP could be described as being incorporated within a radial interface that is formed between the locking assembly 70 and the locking bores 23, 23A-23C.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A camshaft phaser configured for an internal combustion engine, the camshaft phaser comprising:

a stator;

a rotor rotatable with respect to the stator;

a locking cover non-rotatably fixed to the stator, the locking cover having a locking cavity; and a locking assembly configured to be actuated via a pressurized hydraulic fluid within the locking cavity, the locking assembly comprising a locking part arranged within a bore of the rotor; and in a first locked position of the locking assembly, a first end of the locking part protrudes from a first locking end of the bore and engages the locking cavity; and in a second unlocked position of the locking assembly, the pressurized hydraulic fluid within the locking cavity yields a force acting on the first end of the locking part that is greater than a biasing force acting on the locking part to move the locking part out of the locking cavity so that the rotor can rotate relative to the stator; and the bore includes a contaminant particle exit pathway extending from the first locking end to a second venting end of the bore so that contaminant particles entering the first locking end are exited out the second venting end via the contaminant particle exit pathway.

2. The camshaft phaser of claim 1, wherein the contaminant particle exit pathway comprises:

a radial passage extending radially outwardly from the bore; and a longitudinal passage fluidly connected to the radial passage.

3. The camshaft phaser of claim 2, wherein the longitudinal passage is continuously fluidly connected to the radial passage.

4. The camshaft phaser of claim 3, wherein the radial passage is a radial groove configured to extend for 360 degrees around the locking part.

5. The camshaft phaser of claim 3, wherein the longitudinal passage is a longitudinal channel extending radially outwardly from the bore.

6. The camshaft phaser of claim 3, wherein the longitudinal passage extends to a medial longitudinal position within the bore and the contaminant particle exit pathway is configured to be:

fluidly disconnected from the locking cavity by the locking part in the first locked position; and fluidly connected to the locking cavity by the locking part in the second unlocked position;

fluidly disconnected from the second venting end of the bore by the locking part in the second unlocked position; and fluidly connected to the second venting end of the bore by the locking part in the first locked position.

7. The camshaft phaser of claim 3, wherein the contaminant particle exit pathway is closed by the locking part in the first locked position and opened by the locking part in the second unlocked position.

8. The camshaft phaser of claim 3, wherein the locking assembly further comprises a retainer and the longitudinal passage extends to a spring well formed between the retainer and the locking part.

9. The camshaft phaser of claim 8, wherein the retainer includes an outlet passage configured to fluidly connect the spring well to the second venting end of the bore.

10. The camshaft phaser of claim 9, wherein the second venting end is fluidly connected to a vent passage arranged on an axial face of the rotor.

11. The camshaft phaser of claim 3, wherein the longitudinal passage extends from the radial passage to the second venting end of the bore configured as a first open end of the bore.

12. The camshaft phaser of claim 3, wherein:

in the first locked position, the radial passage is fluidly disconnected from the first locking end of the bore via the locking part, and in the second unlocked position, the radial passage is fluidly connected to the first locking end of the bore.

13. The camshaft phaser of claim 2, wherein the radial passage is configured to receive the pressurized hydraulic fluid from the locking cavity when the locking assembly is in the second unlocked position, the pressurized hydraulic fluid configured to yield the force that is greater than the biasing force acting on the locking part.

14. The camshaft phaser of claim 1, wherein the contaminant particle exit pathway comprises:

a radial passage arranged on a portion of the bore configured to slidably receive the first end of the locking part such that the radial passage extends radially outwardly from the portion of the bore; and a longitudinal passage fluidly connected to the radial passage and extending toward the second venting end of the bore.

15. A camshaft phaser configured for an internal combustion engine, the camshaft phaser comprising:

a stator;

a rotor rotatable with respect to the stator;

a locking cover non-rotatably fixed to the stator; and a locking assembly configured to be actuated via hydraulic fluid to selectively lock the rotor to the stator, the locking assembly having a movable locking part arranged within a bore of the rotor; and the bore includes a first radial groove and a second longitudinal passage fluidly connected to the first radial groove such that the first radial groove and the second longitudinal passage define at least a portion of a contaminant particle exit pathway configured to move contaminant particles from a first locking end of the bore to a second venting end of the bore via the locking assembly, and wherein:

the first radial groove is arranged radially between the movable locking part and the bore; and the first radial groove is offset from the first locking end such that:

in a first locked position of the movable locking part, the first radial groove is sealingly covered by the movable locking part; and in a second unlocked position of the movable locking part, the first radial groove is uncovered by the movable locking part.

16. A camshaft phaser configured for an internal combustion engine, the camshaft phaser comprising:

a stator;

a rotor rotatable with respect to the stator;

a locking cover non-rotatably fixed to the stator; and a locking assembly arranged within a bore of the rotor and configured to be actuated via hydraulic fluid to selectively lock the rotor to the stator, the locking assembly having a movable locking part and a spring, and a first end of the movable locking part configured to engage the stator; and the locking assembly and the bore define a contaminant particle exit pathway extending from a first open end of the bore to a second venting end of the bore so that contaminant particles entering the first open end are exited out of the second venting end via the contaminant particle exit pathway, wherein the contaminant particle exit pathway comprises:

a radial passage offset from the first open end of the bore, the radial passage extending: i) radially outwardly from the bore, and ii) completely around the first end of the movable locking part so that the first end of the movable locking part is cleansed via the radial passage; and a first longitudinal passage continuously fluidly connected to the radial passage, the first longitudinal passage arranged downstream of the radial passage.

17. The camshaft phaser of claim 16, wherein the locking assembly further comprises a retainer, and a spring well is formed between the movable locking part and the retainer, and a second longitudinal passage is arranged radially between the retainer and the bore.

18. The camshaft phaser of claim 17, wherein the second longitudinal passage is arranged on the retainer.

19. The camshaft phaser of claim 16, wherein the first longitudinal passage extends from the radial passage to the second venting end of the bore configured as a second open end of the bore.

20. The camshaft phaser of claim 16, wherein the radial passage is arranged on a radial inner surface of the bore configured to slidably receive the first end of the movable locking part such that the radial passage extends radially outwardly from the radial inner surface of the bore configured to slidably receive the first end of the movable locking part.

* * * * *